US010493461B2

(12) United States Patent
Shirai et al.

(10) Patent No.: US 10,493,461 B2
(45) Date of Patent: Dec. 3, 2019

(54) DISCHARGE PORTION LINER ATTACHMENT STRUCTURE FOR VERTICAL SHREDDER

(71) Applicant: KUBOTA ENVIRONMENTAL SERVICE CO., LTD., Tokyo (JP)

(72) Inventors: Atsuhiko Shirai, Kitakatsuragi-gun (JP); Katsuya Shibata, Osaka (JP)

(73) Assignee: KUBOTA ENVIRONMENTAL SERVICE CO., LTD., Tokyo (JP)

( * ) Notice: Subject to any disclaimer, the term of this patent is extended or adjusted under 35 U.S.C. 154(b) by 384 days.

(21) Appl. No.: 15/282,671

(22) Filed: Sep. 30, 2016

(65) Prior Publication Data

US 2017/0095822 A1 Apr. 6, 2017

(30) Foreign Application Priority Data

Oct. 2, 2015 (JP) ..... 2015-196802

(51) Int. Cl.
*B02C 13/286* (2006.01)
*B02C 13/18* (2006.01)
(Continued)

(52) U.S. Cl.
CPC ..... *B02C 13/286* (2013.01); *B02C 13/14* (2013.01); *B02C 13/18* (2013.01);
(Continued)

(58) Field of Classification Search
CPC ..... B02C 13/286; B02C 13/14; B02C 13/18; B02C 13/2216
(Continued)

(56) References Cited

U.S. PATENT DOCUMENTS 1,994,224 A * 3/1935 Whitmer ..... B02C 1/043 241/148
2,355,784 A * 8/1944 Dondlinger ..... B02C 13/14 241/188.1
(Continued)

FOREIGN PATENT DOCUMENTS

JP 167532 10/1944
JP S50-049580 A 5/1975
(Continued)

OTHER PUBLICATIONS

Shirai, Atsuhiko, JP 2001246275 A English Translation, 2001.*
(Continued)

*Primary Examiner* — Adam J Eiseman
*Assistant Examiner* — Bobby Yeonjin Kim
(74) *Attorney, Agent, or Firm* — Oliff PLC

(57) ABSTRACT

In a discharge portion liner attachment structure for a vertical shredder including a sweeper supported below a rotor in such a manner as to be coaxial with a rotation shaft, a discharge ring disposed on a circumference portion of the sweeper, and a discharge portion through which a shredding target object that has been swept out through an opening formed on a circumference wall of the discharge ring by a sweeping operation performed by the sweeper is discharged to outside, discharge portion liners are attached in such a manner as to protrude from a side of the discharge portion to a side of the discharge ring in such a manner as to cover edge portions of ones of the discharge ring liners on a side of the opening.

7 Claims, 6 Drawing Sheets

(51) Int. Cl.
*B02C 18/22* (2006.01)
*B02C 13/14* (2006.01)
*B02C 13/282* (2006.01)

(52) U.S. Cl.
CPC .. *B02C 18/2216* (2013.01); *B02C 2013/2825* (2013.01); *B02C 2013/28609* (2013.01); *B02C 2210/02* (2013.01)

(58) Field of Classification Search
USPC ..... 241/166, 167
See application file for complete search history.

(56) References Cited

U.S. PATENT DOCUMENTS 2,700,512 A * 1/1955 Denovan ..... B02C 13/14 241/154
3,313,332 A * 4/1967 Otto ..... A47J 43/046 241/101.8
3,883,080 A * 5/1975 Andersson ..... B02C 17/225 241/182
4,015,781 A * 4/1977 Beck ..... B02C 18/086 241/46.11
4,033,518 A * 7/1977 Fleming ..... A01F 29/00 180/53.1
4,231,528 A * 11/1980 Schaeffer ..... B02C 17/22 241/182
4,240,244 A * 12/1980 Martin ..... A01D 43/14 241/166
4,295,615 A * 10/1981 Mishek ..... B02C 17/22 241/182
4,580,734 A * 4/1986 Eroskey ..... B02C 17/225 241/182
4,609,158 A * 9/1986 Wilson ..... B02C 17/22 241/182
5,562,256 A * 10/1996 Wolman ..... A47J 43/255 241/167
6,082,646 A * 7/2000 Clarke ..... B02C 17/22 241/182
9,403,167 B2 * 8/2016 Watts ..... B02C 18/12
2006/0196983 A1 9/2006 Schmitz
2009/0218423 A1 * 9/2009 Elsing ..... B02C 13/18 241/19
2013/0037640 A1 2/2013 Mossotti
2015/0069159 A1 * 3/2015 Didion ..... B02C 17/1825 241/182
2015/0224509 A1 * 8/2015 Serrano ..... B02C 11/00 241/299

FOREIGN PATENT DOCUMENTS

JP S51-130976 U 10/1976
JP S54-036662 A 3/1979
JP 3059207 U 7/1999
JP 2001246275 A * 9/2001 ..... B02C 13/286
JP 2003-10708 A 1/2003

OTHER PUBLICATIONS

Feb. 27, 2017 Search Report issued in European Patent Application No. 16191133.4.
Apr. 16, 2019 Office Action issued in Japanese Patent Application No. 2015-196802.

* cited by examiner

DISCHARGE PORTION LINER ATTACHMENT STRUCTURE FOR VERTICAL SHREDDER

CROSS-REFERENCE TO RELATED APPLICATIONS

The present application claims priority under 35U.S.C.119 to Japanese Patent Application No. 2015-196802 filed on Oct. 2, 2015, the contents of this application are incorporated herein by reference in their entirety.

BACKGROUND OF THE INVENTION

Field of the Invention

The present invention relates to a discharge portion liner attachment structure for a vertical shredder that shreds discarded household electric appliances and the like.

Description of the Related Art

Vertical shredders are used as devices that perform a shredding process for recycling discarded household electric appliances such as a refrigerator that have been collected.

The vertical shredder includes: a rotor that is supported on a rotation shaft rotating about a vertical axis; a cylindrical shell that is disposed on an outer side of the rotor in a radial direction in such a manner as to be concentric with the vertical axis, and has an inner circumference portion on which a shell liner is attached; a breaker that is supported by the rotation shaft above the rotor; a sweeper supported below the rotor in such a manner as to be coaxial with the rotation shaft; a discharge ring disposed on a circumference portion of the sweeper; and a discharge portion through which a shredded material that has been swept out through an opening formed on a circumference wall of the discharge ring by the sweeping operation performed by the sweeper is discharged to the outside.

Japanese Utility Model No. 3059207 (hereinafter, referred to as "Patent Literature 1") discloses a vertical shredder including a breaker (described as a "knocker" in Patent Literature 1), a rotor, and a sweeper that are rotatable about a vertical axis both in normal and reverse directions. In the vertical shredder, liners are attached to both left and right side surfaces of the breaker and the sweeper, serving as smashing surfaces.

In the vertical shredder, the discharge ring, having discharge ring liners disposed on its inner circumference portion, is disposed on a circumference portion of the sweeper in such a manner as to extend along the rotational trajectory of the sweeper. The shredding target object is swept out through the opening formed on a part of the circumference wall of the discharge ring by the sweeping operation.

The discharge ring disclosed in Patent Literature 1 is provided with an opening formed in such a manner that an angle between both left and right edges of the opening about the rotation shaft is approximately 180°.

When such an opening is employed, sufficient strength to hold heavy components installed above the discharge ring, such as the cylindrical shell, is difficult to achieve. Thus, an additional supporting structure for reinforcement and the like are required. As a result, the structure might be complex and expensive due to the increase in the number of components.

Thus, a configuration may be employed in which the angle between both the left and right edges of the opening about the rotation shaft is set to be smaller than 180°, so that the cylindrical shell and the like can be supported by the discharge ring only and no additional supporting structure is required. Unfortunately, in this configuration, ones of the discharge ring liners close to the opening frequently come into contact with the shredding target object that is swept out through the opening by centrifugal force acting thereon due to the sweeping operation performed by the sweeper, and thus are heavily worn.

Thus, these discharge ring liners need to be frequently replaced. Furthermore, the replacing requires extremely cumbersome maintenance work of removing heavy components such as the rotor disposed above the discharge ring liners.

SUMMARY OF THE INVENTION

The present invention is made in view of the conventional problem described above and an object of the present invention is to provide a discharge portion liner attachment structure for a vertical shredder in which wearing of the discharge ring liners is prevented so that the discharge ring liners need not to be frequently replaced and easy maintenance can be achieved.

A discharge portion liner attachment structure for a vertical shredder according to an aspect of the present invention includes a rotor that is supported on a rotation shaft rotating about a vertical axis and includes a shredding mechanism, a cylindrical shell that is disposed on an outer side of the rotor in a radial direction in such a manner as to be concentric with the vertical axis, a sweeper supported below the rotor in such a manner as to be coaxial with the rotation shaft, a discharge ring disposed on a circumference portion of the sweeper and having an inner circumference portion on which the discharge ring liners are disposed, and a discharge portion through which a shredding target object that has been swept out through an opening formed on a circumference wall of the discharge ring by a sweeping operation performed by the sweeper is discharged to outside, characterized in that discharge portion liners are attached in such a manner as to protrude from a side of the discharge portion to a side of the discharge ring in such a manner as to cover edge portions of ones of the discharge ring liners on a side of the opening in the pair of discharge ring liners.

Preferably, the discharge portion liners each include: a facing edge portion facing the edge portion of one of the discharge ring liners on the side of the opening; and a thick part disposed adjacent to the facing edge portion and having a surface that continues from a surface of the discharge ring liner with same curvature.

Preferably, the discharge portion liners each are attachable to both left and right edges of the opening by being flipped upside down.

Preferably, an angle between left and right edges of the opening about the rotation shaft is less than 180°.

Further aspects of the invention will be apparent by referring to an embodiment described below.

BRIEF DESCRIPTION OF THE DRAWINGS

Some embodiments of the present disclosure are shown by way of example, and not limitation, in the accompanying figures.

DETAILED DESCRIPTION OF THE EMBODIMENTS

A breaker liner attachment structure and a discharge portion liner attachment structure for a vertical shredder are described with reference to the drawings.

Figure 2A:
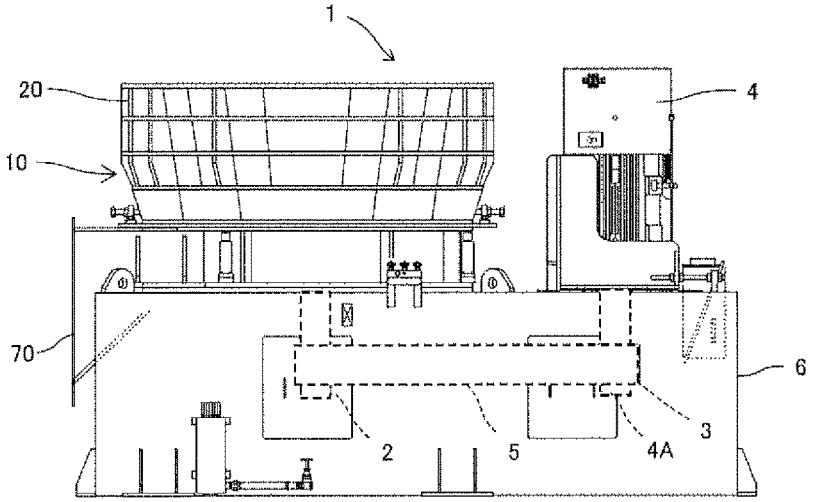
FIG. 2A is a front view of the vertical shredder.
Figure 2B:
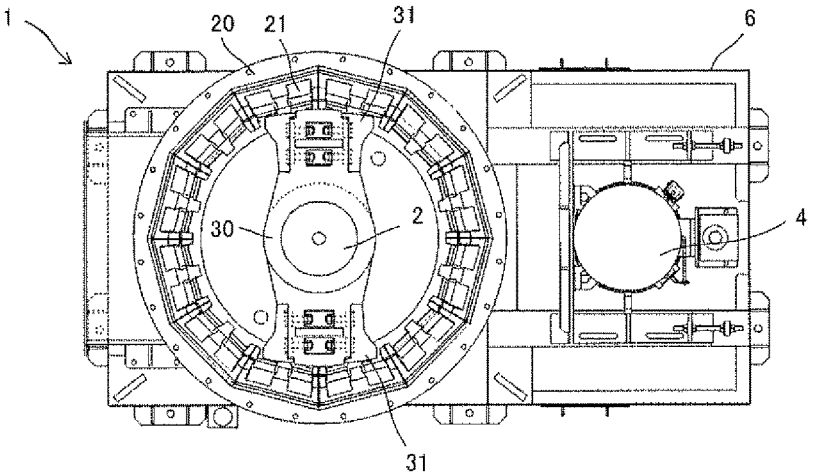
FIG. 2B is a plan view of the vertical shredder.
Figure 2C:
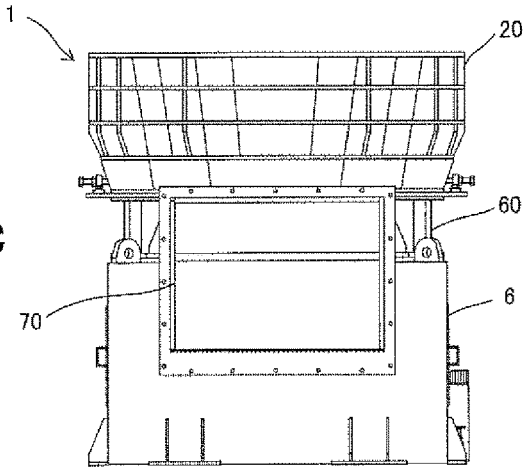
FIG. 2C is a left side view of the vertical shredder.

As illustrated in FIG. 2A, FIG. 2B, and FIG. 2C, a vertical shredder 1 is a device that performs a shredding process on a household electric appliance such as a refrigerator, and includes a motor 4 provided to a device frame 6 and a shredding process unit 10. The shredding process unit 10 includes components such as: a discharge ring 60 fixed to the device frame 6; a cylindrical shell 20 disposed above the discharge ring 60; and a breaker 30 rotatably accommodated in the cylindrical shell 20. A shredded material by the shredding process unit 10 is swept out through a discharge portion 70.

In the device frame 6, a pulley 3 attached to an output shaft 4A of the motor 4, is coupled to a pulley provided to a rotation shaft 2 of the shredding process unit 10 via a V belt 5 in a driving force transmittable manner. Thus, a rotor 40 is rotated relative to the cylindrical shell 20 by driving force from the motor 4. The rotation shaft 2 can rotate in normal and reverse directions, through rotation of the motor 4 in the normal and reverse directions.

Figure 1A:
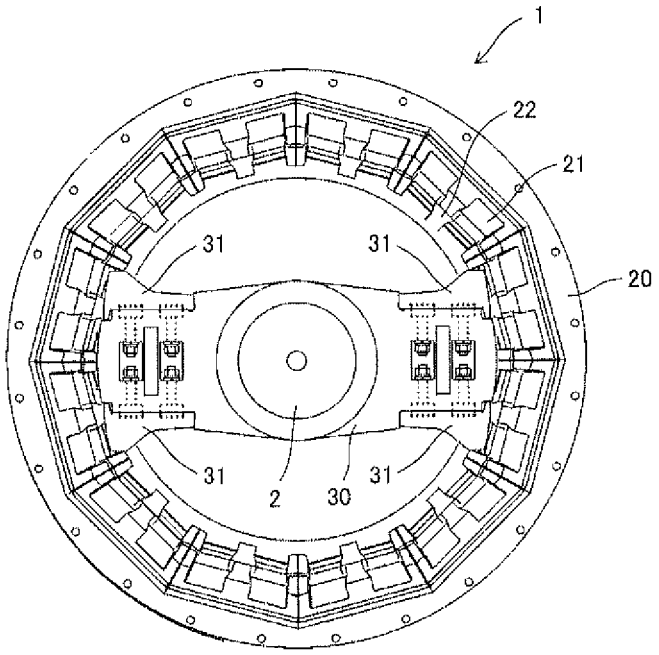
FIG. 1A is a plan view of a main portion of a vertical shredder.
Figure 1B:
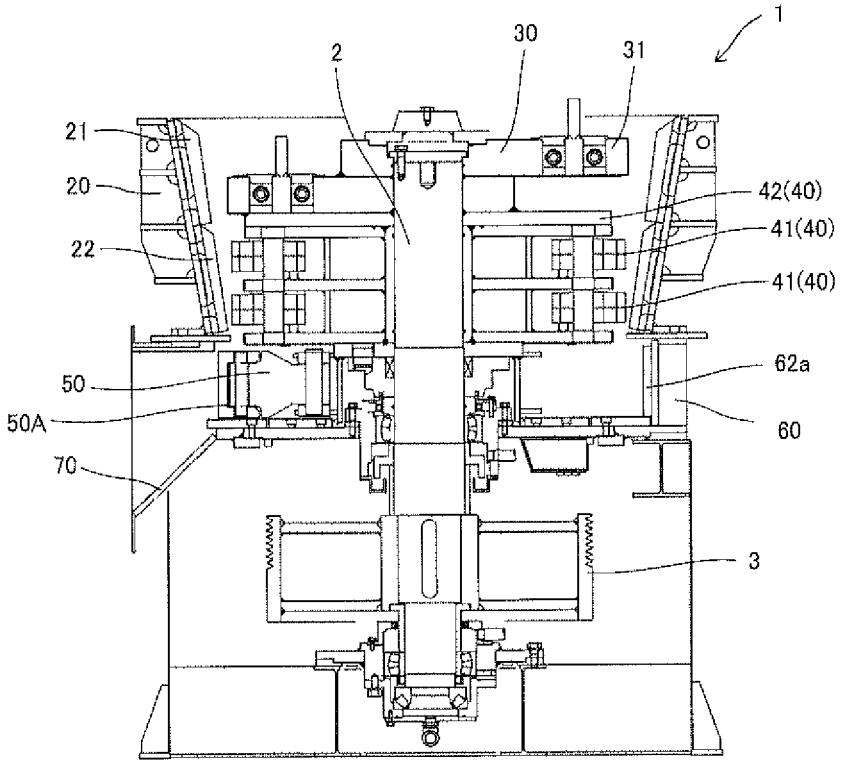
FIG. 1B is a longitudinal cross-sectional view of the vertical shredder.

As illustrated in FIG. 1A and FIG. 1B, the cylindrical shell 20 has an inner circumference portion provided with upper and lower shell liners 21 and 22 on which ribs are formed to extend vertically. The breaker 30, the rotor 40, and a sweeper 50, on the inner side of the cylindrical shell 20, are supported by the rotation shaft 2 in such a manner as to be integrally rotatable about a vertical axis, and are arranged in this order from the upper side. The rotor 40 includes: a disk 42; and a plurality of shredding grinders 41, serving as a shredding mechanism, supported on outer circumference portions of the disk 42 in such a manner as to be freely rotatable. The shredding mechanism is not limited to the shredding grinders 41, and may employ any other known configuration.

The shredding target object put in from the upper side is smashed and shredded by the breaker 30, and is then conveyed downward while being shredded between the shell liners 21 and 22 and the shredding grinders 41 into small pieces to fall into the discharge ring 60 disposed on a lower side of the cylindrical shell 20.

The shredded material fell into the discharge ring 60 is swept out through an opening 50A formed on a circumference wall of the discharge ring 60, by a sweeping operation performed by the sweeper 50 by rotating about the rotation shaft 2, to be discharged to the outside through the discharge portion 70.

Figure 3C:
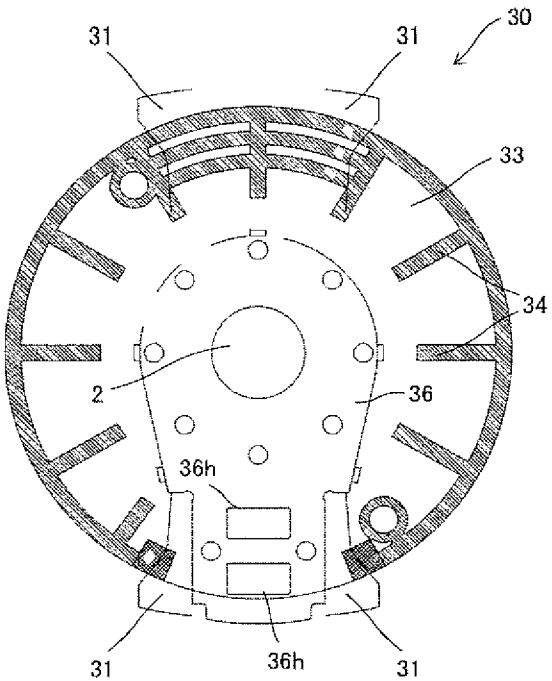
FIG. 3C is a plan view of a main portion of the breaker.
Figure 3B:
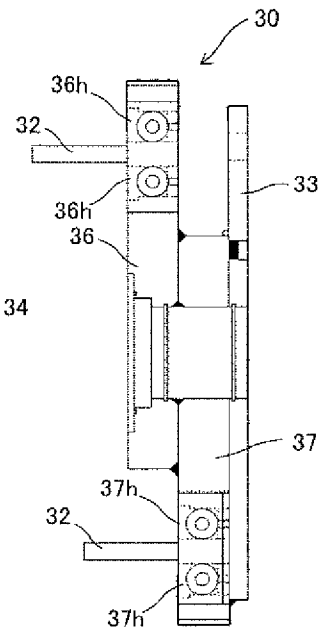
FIG. 3B is a right side view of the breaker.
Figure 3A:
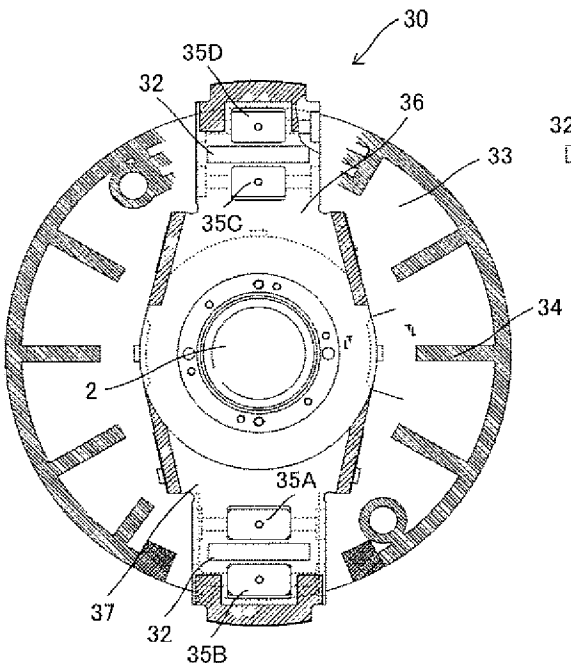
FIG. 3A is a plan view of a breaker.
Figure 4A:
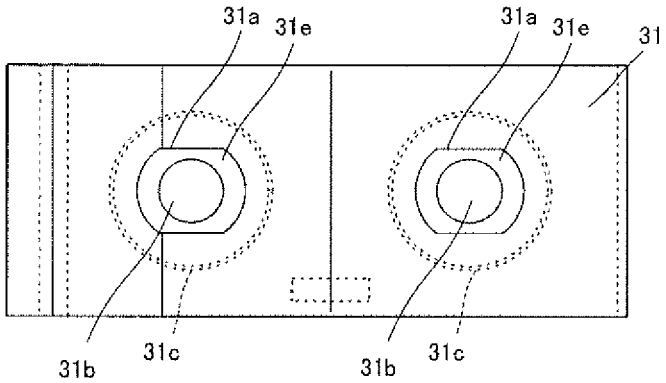
FIG. 4A is a plan view of a breaker liner.
Figure 4B:
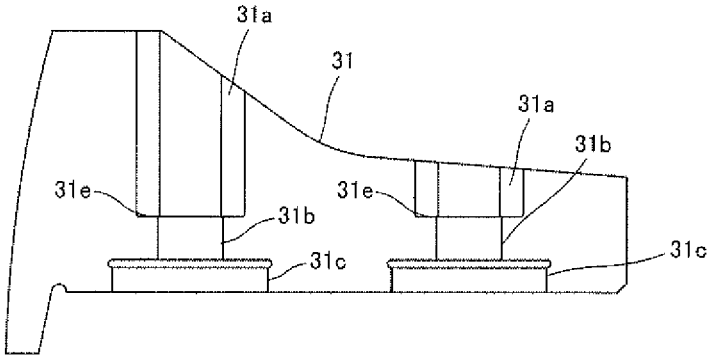
FIG. 4B is a front cross-sectional view of the breaker liner.
Figure 4C:
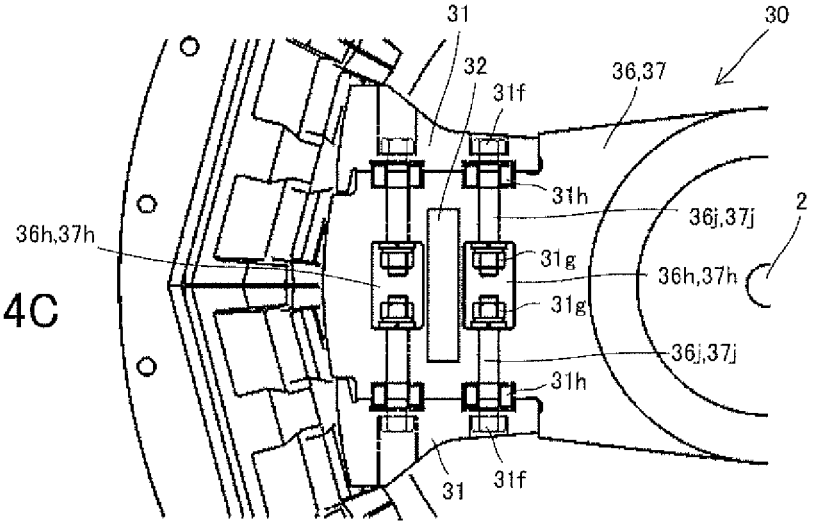
FIG. 4C is a diagram illustrating a main portion in a state where the breaker liner is attached.

As illustrated in FIG. 3A, FIG. 3B, and FIG. 3C, the breaker 30 includes: a base 33 having a disk shape inserted in the rotation shaft 2 and integrally rotates with the rotation shaft 2; and first arm member 36 and second arm member 37 that are disposed on the upper side of the base 33. The first arm member 36 and the second arm member 37 are each formed to extend in a radial direction of the base 33, in such a manner as to be at 180° relative to each other. The first arm member 36 is disposed more on the upper side than the base 33 in an axis direction by a distance corresponding to the thickness of the second arm member 37.

The shredding target object thrown in the cylindrical shell 20 is smashed and shredded by the first arm member 36 and the second arm member 37 that rotate together with the base 33 about the rotation shaft 2. The shredding target object is conveyed on the base 33 to be guided between the shell liners 21 and 22 and the shredding grinders 41. The base 33 is prevented from wearing in this process with raised portions 34 in a radial form provided on its upper surface. Hatched portions in FIG. 3A and FIG. 3C represent the raised portions 34.

Breaker liners 31 are attached to tips of the first arm member 36 and the second arm member 37 of the breaker 30 to prevent wearing as a result of smashing the shredding target object.

The attachment structure for the breaker liner 31 is described below.

As illustrated in FIG. 3A, FIG. 3B, FIG. 3C, FIG. 4A, FIG. 4B, and FIG. 4C, at least areas of the breakers 30 (36, 37) between the left and right breaker liners 31 are each provided with a corresponding one of pairs of through holes 36*h* and 37*h* formed to extend in the radial direction. Each of the through holes 36*h* and 37*h* has an inner wall on which a corresponding one of bolt insertion holes 36*j* and 37*j* is formed to extend toward the side surface of the breakers 30 (36, 37).

The through holes 36*h* and 37*h* each serve as a hollow portion formed to have an opening on the upper side. This configuration where the hollow portion is the through hole should not be construed in a limiting sense, and a configuration where the hollow portion is a recessed portion having an opening on the upper side and a bottom portion may be employed.

Bolts 31*f* are inserted into the bolt insertion holes 36*j* and 37*j* through attachment holes 31*b* formed on the breaker liners 31. The bolts 31*f* are fastened by using nuts 31*g* from the inner wall side of the through holes 36*h* and 37*h*.

Thus, no long bolt needs to be used and the elongation of the bolt due to the impact and the like as a result of smashing the shredding target object can be prevented, whereby loosening of the nut can be prevented. The shredding target object never comes into contact with the nuts 31*g*, regardless of whether the breaker 30 is rotating in the normal or reverse direction. Thus, the wearing of the nuts 31*g*, rendering them difficult to remove, is prevented.

The through holes 36*h* and 37*h* are preferably formed in a center portion of the breaker 31 in a width direction extending left and right. With this configuration, the both left and right side surfaces of the breakers 30 (36, 37) can be at an equal distance from the center portion where the through holes 36*h* and 37*h* are provided. The bolts 31*f* of equal lengths can be used for attaching the left and right breaker liners 31. The weight balance of the breaker liners 31 is symmetrical on left and right sides, whereby a stable operation can be achieved with rotation in both the normal and the reverse directions.

A counter bore portion 31*a* is formed around each attachment hole 31*h* formed in the breaker liner 31. The counter bore portion 31*a* accommodates a head portion of the bolt 31*f* in a rotation prevented state. Facing surfaces 31*e* of the counter bore portion 31*a* and the head portion of the bolt 31*f* are provided with surface finishing to be smooth surfaces.

As described above, the facing surfaces 31*e* of both the counter bore portion 31*a* and the head portion of the bolt 31*f* are provided with the surface finishing to be smooth surfaces. As a result, the facing surfaces are not largely deformed by the smashing of the shredding target object after the initial fastening fixing. Thus, the fastened state can be prevented from being loosened, whereby no additional fastening work is required.

If the facing surface 31*e* of any one of the counter bore portion 31*a* and the head portion of the bolt 31*f* is formed as a rough surface, recesses and protrusion on the rough surface plastically deform to be flat as a result of smashing the shredding target object after the initial fastening fixing. As a result, a gap is formed between the facing surfaces 31*e*, and thus the additional fastening work is required.

A pair of upper and lower lids 35A and 35B and a pair of upper and lower lids 35C and 35D are further provided to close the through holes 36*h* and 37*h*. The rotation balance of the breakers 30 (36, 37) can be adjusted with the weight of the lids 35A, 35B, 35C, and 35D.

After the breaker liners 31 are attached, the through holes 36*h* and 37*h* are closed with the lids 35A, 35B, 35C, and 35D. Thus, the shredded material after the shredding process is prevented from entering and clogging the through holes 36*h* and 37*h*. The stable rotation can be achieved with the lids 35A, 35B, 35C, and 35D serving as the balance weights for adjusting the balance of the breakers 30 (36, 37) in rotation.

As illustrated in FIG. 1B, the discharge ring 60 is disposed to surround the sweeper 50. The sweeper 50 performs the sweeping operation by rotating about the rotation shaft 2, whereby the shredded material is swept out through the opening 50A formed on the circumference wall of the discharge ring 60. The discharge ring liners 62*a* are disposed on the inner circumference portion of the discharge ring 60, to prevent the discharge ring 60 from wearing.

Figure 5A:
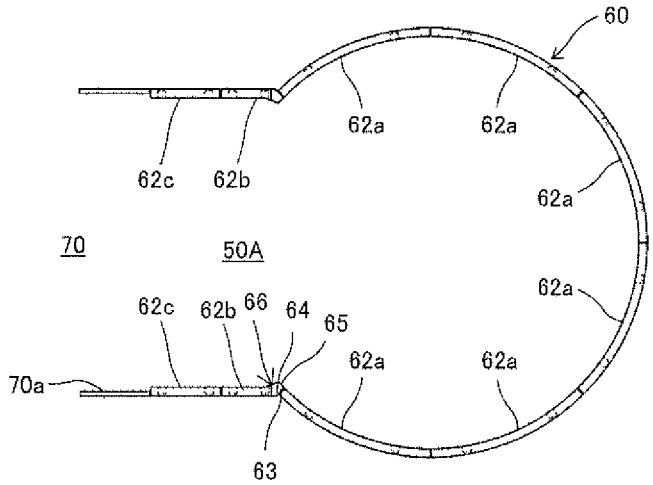
FIG. 5A is a plan view of a discharge ring liner and a discharge portion liner.
Figure 5B:
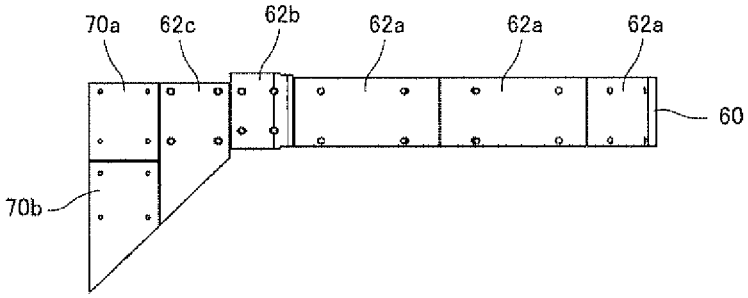
FIG. 5B is a plan view of the discharge ring liner and the discharge portion liner.

As illustrated in FIG. 5A and FIG. 5B, the discharge portion liners 62*b* are attached to be in such a manner as to protrude from the discharge portion side toward a side of the discharge ring 60, and cover edge portions 63 of the discharge ring liners 62*a* on a side of the opening 50A.

The edge portions 63 of the discharge ring liners 62*a* positioned on the side of the opening 50A are covered with the discharge portion liners 62*b*. Thus, when the shredded material is swept out through the opening 50A, the discharge portion liners 62*b* wear instead of the edge portions 63 of the discharge ring liners 62*a*. As a result, the discharge ring liners 62*a* requiring a cumbersome work to be replaced are prevented from wearing. The discharge portion liners 62*b* are disposed outside the discharge ring 60 and on a side of the discharge portion 70, and thus can be easily replaced.

Each of the discharge portion liners 62*b* includes: a facing edge portion 64 facing the edge portion 63 of the discharge ring liner 62*a* on the side of the opening 50A; and a thick portion 66 disposed adjacent to the facing edge portion 64 and having a surface 65 that continues from a surface of the discharge ring liner 62*a* with the same curvature.

With this configuration, the shredded material guided to the opening 50A along the surface of the discharge ring liner 62*a* by the sweeping operation of the sweeper 50 is finally swept out in the radial direction of the discharge ring 60 while being in contact with the surface 65 of the thick portion 66 of the discharge portion liner 62*b*. This means that the portion to be most heavily worn is thick, and thus the maintenance does not need to be frequently performed.

Figure 6A:
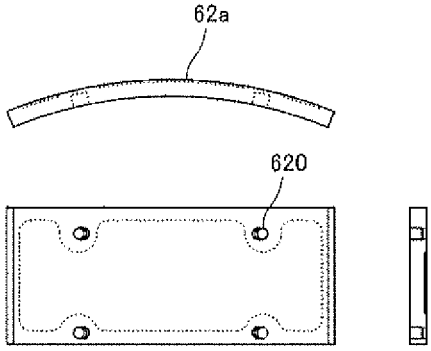
FIG. 6A is a diagram illustrating the discharge ring liner.
Figure 6B:
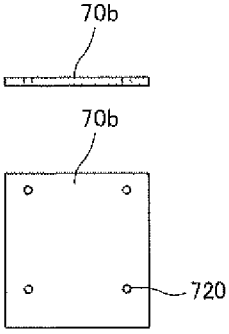
FIG. 6B is a diagram illustrating the discharge portion liner.
Figure 6C:
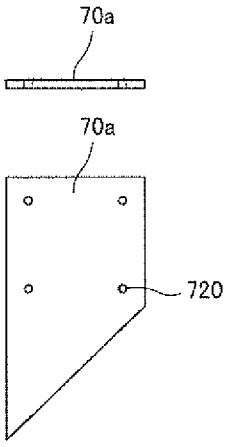
FIG. 6C is a diagram illustrating the discharge portion liner.
Figure 6D:
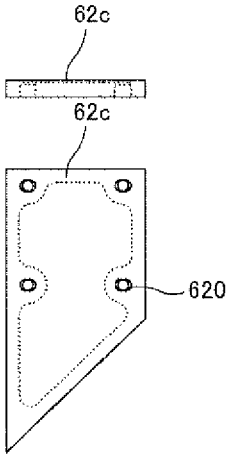
FIG. 6D is a diagram illustrating the discharge portion liner.

FIG. 6A illustrates a structure of each of the discharge ring liners 62*a*, attached to the discharge ring 60 via upper and lower attachment holes 620, as viewed from front, above, and side. FIG. 6B to FIG. 6D respectively illustrate structures of discharge portion liners 62*c*, 70*a*, and 70*b*, illustrated in FIG. 5B, as viewed from front and above. The discharge portion liners 62*c*, 70*a*, and 70*b* are each attached to the side wall of the discharge portion 70 via the upper and lower attachment holes 620.

Figure 6E:
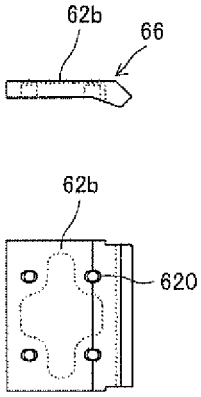
FIG. 6E is a diagram illustrating the discharge portion liner.
Figure 6F:
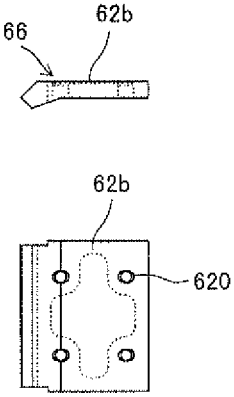
FIG. 6F is a diagram illustrating the discharge portion liner.

As illustrated in FIG. 6E and FIG. 6F, the discharge portion liner 62*b* according to the present invention can be attached to both left and right sides of the opening 50A by being flipped upside down. The same discharge portion liner 62*b* can be attached to both left and right sides of the opening 50A. Thus, the common parts can be used, and the liners on the left and right sides of the opening 50A can be flipped upside down and attached when there is uneven wearing between upper and lower sides. Thus, an attempt to reduce cost can be effectively facilitated.

When the angle between the left and right edges of the opening 50A about the rotation shaft 2 is less than 180° as in the embodiment described above, no support mechanism needs to be additionally provided for supporting the cylindrical shell 20 disposed above the discharge ring 60. Thus, the vertical shredder 1 can have a simple structure with a compact discharge portion.

The embodiment described above is merely an example of the present invention. It is a matter of course that the specific structure, shape, size and the like of each of the components may be designed to be different as long as the advantageous effects of the present invention can be achieved.

DESCRIPTION OF SYMBOLS

1: vertical shredder
20: tubular shell
21, 22: shell liner
30: breaker
31: breaker liner
40: rotor
50: sweeper
50A: opening
60: discharge ring
62*a*: discharge ring liner
62*b*: discharge portion liner
70: discharge portion

What is claimed is:

1. A discharge portion liner attachment structure for a vertical shredder including a rotor that is supported on a rotation shaft rotating about a vertical axis and includes a shredding mechanism, a tubular shell that is disposed on an outer side of the rotor in a radial direction in such a manner as to be concentric with the vertical axis, a sweeper supported by the rotation shaft below the rotor, a discharge ring disposed around the sweeper, and a discharge portion through which a shredding target object that has been swept out through an opening formed on a circumference wall of the discharge ring by a sweeping operation performed by the sweeper is discharged to outside, the discharge portion liner attachment structure comprising:

discharge ring liners disposed on an inside surface of the discharge ring; and discharge portion liners fastened in such a manner as to protrude from a side of the discharge portion to a side of the discharge ring in such a manner that each of the discharge portion liners covers a side edge of a respective discharge ring liner adjoining the opening, the side edge being a radial surface of the respective discharge ring liner closest to the opening, wherein each of the discharge portion liners includes a thick portion disposed adjacent the side edge that protrudes further into the discharge portion than a remainder of the discharge portion liner, and the thick portion includes a surface that continues from a surface of the corresponding discharge ring liner, the surface of the corresponding discharge ring liner being an inner radial surface of the corresponding discharge ring liner, and the surface of the thick portion includes a curvature that is the same as a curvature of the surface of the discharge ring liner.

2. The discharge portion liner attachment structure for the vertical shredder according to claim 1, wherein the discharge portion liners each include:

a facing edge portion facing the edge portion of the discharge ring liners on a side of the opening in the pair of discharge ring liners.

3. The discharge portion liner attachment structure for the vertical shredder according to claim 1, wherein the discharge portion liners each are attachable to both left and right edges of the opening by being flipped upside down.

4. The discharge portion liner attachment structure for the vertical shredder according to claim 1, wherein an angle between left and right edges of the opening about the rotation shaft is less than 180°.

5. The discharge portion liner attachment structure for the vertical shredder according to claim 2, wherein an angle between left and right edges of the opening about the rotation shaft is less than 180°.

6. The discharge portion liner attachment structure for the vertical shredder according to claim 3, wherein an angle between left and right edges of the opening about the rotation shaft is less than 180°.

7. The discharge portion liner attachment structure for the vertical shredder according to claim 1, wherein each of the discharge portion liners is fastened to a side wall of the discharge portion.

* * * * *